United States Patent [19]

Stellaccio

[11] 4,402,711

[45] Sep. 6, 1983

[54] PARTIAL OXIDATION PROCESS WITH EXTRACTANT PURIFICATION

[75] Inventor: Robert J. Stellaccio, Spring, Tex.

[73] Assignee: Texaco Inc., White Plains, N.Y.

[21] Appl. No.: 372,422

[22] Filed: Apr. 27, 1982

[51] Int. Cl.[3] ..... C10J 3/46; C10J 3/84

[52] U.S. Cl. ..... 48/197 R; 48/215; 210/774; 210/803; 252/373

[58] Field of Search ..... 48/197 R, 200, 201, 48/206, 215; 252/373; 210/768, 774, 803, 808

[56] References Cited

U.S. PATENT DOCUMENTS

| | | | |
|---|---|---|---|
| 3,044,179 | 7/1962 | Chapman et al. | 48/215 |
| 3,980,592 | 9/1976 | Marion | 48/197 R |
| 4,134,740 | 1/1979 | Marion et al. | 48/197 R |
| 4,141,696 | 2/1979 | Marion et al. | 48/197 R |
| 4,205,963 | 8/1980 | Marion et al. | 48/197 R |

*Primary Examiner*—Peter F. Kratz

*Attorney, Agent, or Firm*—Carl G. Ries; Robert A. Kulason; Albert Brent

[57] ABSTRACT

A partial oxidation process with an extractant purifier for removing the particulate carbon entrained in a vaporized stream of normally liquid organic extractant-carbon-water dispersion from a decanter and producing a clean vaporized mixture of liquid organic extractant and water and a separate liquid stream of liquid hydrocarbonaceous fuel-carbon dispersion. The extractant purifier comprises a closed, vertical, cylindrical, thermally insulated vessel with an unobstructed central passage. Supported in the upper section of the vessel is a gas-solids separator for separating the particulate carbon from the vaporized dispersion flowing up the vessel and discharging the particulate carbon into atomized liquid hydrocarbon fuel located within the lower section of the purifier.

8 Claims, 1 Drawing Figure

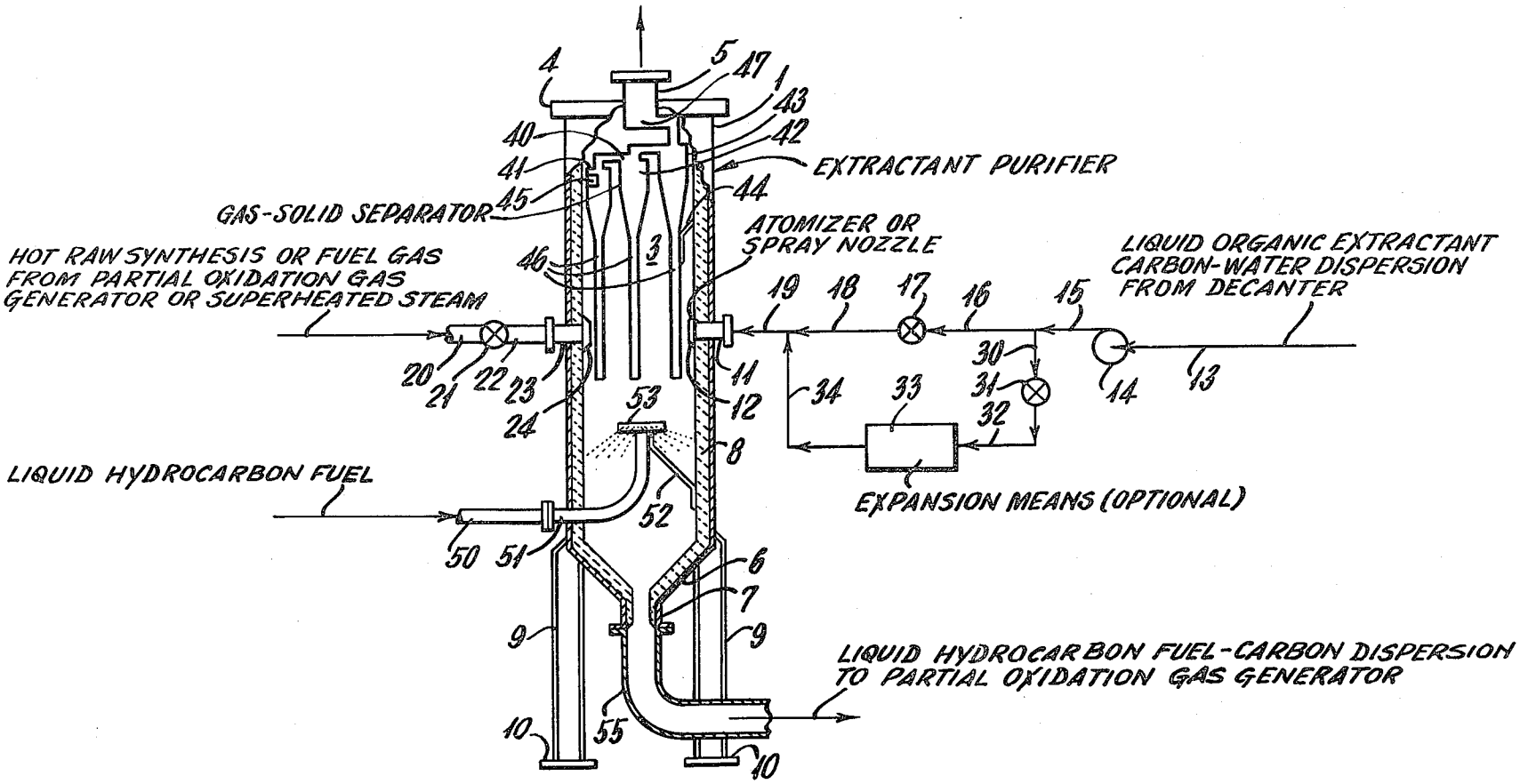
LIQUID ORGANIC EXTRACTANT CARBON-WATER DISPERSION FROM DECANTER
EXTRACTANT PURIFIER
ATOMIZER OR SPRAY NOZZLE
EXPANSION MEANS (OPTIONAL)
LIQUID HYDROCARBON FUEL-CARBON DISPERSION TO PARTIAL OXIDATION GAS GENERATOR
GAS-SOLID SEPARATOR
HOT RAW SYNTHESIS OR FUEL GAS FROM PARTIAL OXIDATION GAS GENERATOR OR SUPERHEATED STEAM
LIQUID HYDROCARBON FUEL

PARTIAL OXIDATION PROCESS WITH EXTRACTANT PURIFICATION

BACKGROUND OF THE INVENTION

This invention relates to the quench cooling and cleaning of raw synthesis or fuel gas containing entrained particulate carbon as produced by the partial oxidation of a liquid hydrocarbonaceous fuel. More specifically, it relates to an apparatus for continuously separating into its component materials a stream of liquid organic extractant-carbon-water dispersion from a decanter that is employed in the synthesis or fuel gas quench cooling and cleaning operation.

Raw effluent gas leaving a partial oxidation gas generator may comprise principally CO, $H_2$, $CO_2$ and $H_2O$ together with other gaseous constituents and minor amounts of entrained finely divided carbon. The particulate carbon is commonly referred to as soot. Cleaning and purifying the raw effluent gas to produce synthesis gas or fuel gas usually starts with the removal of the particulate carbon and any other entrained solids. This will extend the life of any catalyst or solvent that may be later contacted by the process gas stream. Synthesis gas is important commercially as a source of feed gas for the synthesis of hydrocarbons or oxygen containing organic compounds, or for producing hydrogen or ammonia.

Entrained particulate carbon may be removed from the raw effluent gas by quenching and scrubbing with water such as described in coassigned U.S. Pat. No. 3,232,728. Cleaning the effluent gas by scrubbing with an oil-carbon slurry is described in coassigned U.S. Pat. No. 3,636,261. Recovery of the particulate carbon from carbon-water dispersions by the steps of adding a light oil to the carbon-water dispersion, separating water and light oil-carbon dispersion in a decanter, mixing the light oil-carbon dispersion with heavy oil and heating in a preheater, and vaporizing the light oil in a flash drum or distillation tower is described in coassigned U.S. Pat. Nos. 2,999,741; 2,992,906, 3,004,179; and 4,134,740. Typical decanting procedures are described in coassigned U.S. Pat. Nos. 3,980,592 and 4,014,786. However, the subject process is more thermally efficient and eliminates costly distillation equipment. Further, more concentrated liquid extractant-carbon dispersions from the decanter may be handled; and, dispersions of liquid hydrocarbonaceous fuel and carbon are easily obtained which may be recycled to the gas generator as a portion of the fuel.

SUMMARY

The subject invention pertains to an extractant purifier which is incorporated in a system for reclaiming water used for quench cooling and scrubbing raw synthesis or fuel gas containing entrained particulate carbon as produced by the partial oxidation of a liquid hydrocarbonaceous fuel. The extractant purifier removes the particulate carbon entrained in a vaporized stream of normally liquid organic extractant-carbon-water dispersion that was previously separated from clarified water in a decanter and provides a clean vaporized mixture of liquid organic extractant and water and a separate liquid stream of liquid hydrocarbon fuel-carbon dispersion. This dispersion is introduced into the partial oxidation gas generator as a portion of the reactant fuel. Clean liquid organic extractant is separated from the vaporized mixture after cooling and recycled to the decanter. The extractant purifier comprises a closed, vertical, cylindrical, thermally insulated pressure vessel having an unobstructed central passage for the upward flow of vaporized normally liquid organic extractant-carbon-water dispersion. The vaporization of this dispersion takes place within the vessel by direct contact with a portion of the hot raw synthesis or fuel gas from the partial oxidation gas generator which is introduced into the vessel by way of an opposed conduit. Alternatively, the normally liquid organic extractant-carbon-water dispersion may be at least partially vaporized by being passed through an external expansion means such as a heater, expansion turbine, orifice, or expansion valve. Any supplemental energy required for completely vaporizing the liquid organic extractant and water in the dispersion may be obtained from the sensible heat in the raw synthesis or fuel gas. A sparger or atomizer is positioned in the lower portion of the vessel for providing a liquid hydrocarbon spray. A gas-solids separator is supported within the upper portion of the vessel for receiving the vaporized liquid organic extractant-carbon-water dispersion passing up the vessel, removing particulate carbon therefrom, discharging a clean vaporized mixture of normally liquid organic extractant and water, and discharging the particulate carbon through a dip leg into the lower portion of the vessel where it is contacted by the atomized spray of liquid hydrocarbon fuel. An outlet is provided in the bottom of the vessel for discharging a liquid dispersion of liquid hydrocarbon fuel and particulate carbon.

BRIEF DESCRIPTION OF THE DRAWING

The invention will be further understood by reference to the accompanying drawing. The drawing is a schematic representation of a preferred embodiment of the extractant purifier.

DESCRIPTION OF THE PREFERRED EMBODIMENTS

A more complete understanding of the invention may be had by reference to the accompanying drawing which illustrates one embodiment of the invention.

Extractant purifier 1 is a closed, vertical, cylindrical, hollow steel pressure vessel comprising a cylindrical shell body 2 having a substantially unobstructed free-flow central vertical passage 3, upperhead 4 with upper central outlet 5, and frusto-conical shaped bottom 6 with bottom central outlet 7. To prevent heat loss, the inside walls of vessel 1 are lined with thermal insulation, such as refractory lining 8. Support legs 9 and ground pads 10 are provided to hold vertical vessel 1 in an upright position.

A first inlet conduit 11 is provided to introduce into vessel one a feed stream of normally liquid organic extractant-carbon-water dispersion. Spray nozzle 12 at the downstream end of conduit 11 is provided to atomize or to distribute an at least partially vaporized feed steam of the normally liquid organic extractant-carbon-water dispersion. In a preferred embodiment for example, valve 17 is open and valve 31 is closed.

The liquid organic extractant-carbon-water dispersion in line 13, which may or may not have been previously degased, is pumped by means of pump 14 from a conventional decanter (not shown) into vessel 1 by way of lines 15–16, valve 17, lines 18–19 and inlet conduit 11. The temperature and pressure of the dispersion in line 13 is substantially the same as that in the decanter less ordinary drop in the lines i.e. 5 to 100 degrees F. and 1–2 atmospheres. The dispersion in conduit 11 is atomized to produce minute droplets of spray by means of spray nozzle or atomizer 12 connected to the downstream end of conduit 11. In a preferred embodiment, a portion i.e. 5–50 vol.%, such as 10–20 volume precent, say 15 vol% of the hot raw synthesis or fuel gas directly from the reaction zone of a conventional partial oxidation gas generator is passed into vessel 1 by way of refractory lined line 20, valve 21, refractory lined line 22, and refractory lined inlet conduit 23, and nozzle 24. The discharge ends of inlet lines 11 and 23 are located so that the atomized spray from nozzle 12 and the hot raw gas stream from nozzle 24 impinge and direct heat exchange between the streams takes place. For example, lines 11 and 23 may be opposed and 180 degrees apart. In one embodiment, inlet conduits 22 and 23 may be arranged to discharge two separate streams in the same horizontal plane, 180° apart, tangential to the inside vessel walls, and rotating in opposite directions. In another embodiment, the hot raw synthesis or fuel gas is replaced by a stream of superheated steam such as that produced in a conventional cooler for the raw synthesis or fuel gas from the partial oxidation gas generator. By this means, in the preferred embodiment the sensible heat from the hot raw synthesis or fuel gas, or from the superheated steam vaporizes with minimal side effects all of the liquid organic extractant and water within vessel 1. The vaporized mixture then passes up the vessel carrying entrained particulate carbon.

In another embodiment, with valve 17 closed and valve 31 open, the liquid organic extractant-carbon-water dispersion in line 13 may be pumped into vessel 1 by way of lines 15 and 30, valve 31, line 32, expansion means 33, lines 34 and 19, and inlet conduit 11. Expansion means 33 is employed to at least partially vaporize i.e. 5–100 wt.%, such as 10–90 wt.% the liquid organic extractant and the water in the dispersion in line 32. When necessary, additional thermal energy to effect complete vaporization of the dispersion may be obtained from the sensible heat of the hot raw synthesis or fuel gas or from the superheated steam that is then introduced through line 20. Otherwise, valve 21 may be closed. Suitable conventional expansion means 33 include heaters and/or expansion turbines. Alternatively, the expansion means may be an orifice or expansion valve.

Conventional gas-solids separator 40 is supported within the upper section of vessel 1 for removing particulate carbon from the upflowing vaporized dispersion stream. For example, a multi-stage cyclone with side supports 44 and three stages 41–43 is shown in the drawing. Inlet means 45 in first cyclone 41 faces the horizontal circular component of the rising flow pattern of the vaporized dispersion. Discharge pipes or dip legs 46 extend downward from the bottom of each cyclone to well below the discharge ends of inlet conduits 11 and 23. The substantially particulate carbon-free mixture of vaporized liquid organic extractant and $H_2O$ plus any synthesis or fuel gas leaves the last cyclone 43 through chamber 47 and passes out through upper central outlet 5. The vaporized mixture is cooled below the dew points of the liquid organic extractant and the water by means of a cooler located downstream from vessel 1. Being immiscible, the liquid organic extractant separates from the water in a separator and is recycled to the decanting zone where it is mixed with the carbon-water dispersion feed stream. A clean stream of synthesis or fuel gas is removed from the top of the separator. Water, which separates out by gravity, is removed from the bottom of the separator and recycled to the quench cooling or scrubbing zone.

Liquid hydrocarbon fuel in line 50 is pumped into vessel 1 near the lower end by way of inlet conduit 51. Conduit 51 is supported by side bracket 52. The liquid hydrocarbon fuel emerges through spray nozzle or atomizer 53 as a fine spray. Spray nozzle 53 is located below the discharge ends of inlet conduits 11 and 23 as well as below cyclone discharge pipes 46. The dry particulate carbon separated in cyclones 41–43 passes down dip-leg 46 and is discharged within vessel 1 in an area of essentially free-flowing carbon. Further down the vessel, the free falling carbon particles are contacted by the droplets of liquid hydrocarbon fuel from spray nozzle 53. A liquid hydrocarbon fuel-carbon dispersion is thereby produced which falls to the bottom 6 of vessel 1 and is discharged through outlet 7 and line 55. The liquid hydrocarbon fuel-carbon dispersion in line 55 may be burned in the system wherever a heating fuel is required, such as when expansion means 33 is employed and is a heater. However, preferably the dispersion in line 55 is introduced into the partial oxidation gas generator as a portion of the reactant feed so that complete carbon conversion to synthesis gas can be obtained.

The partial oxidation gas generator for producing the hot raw synthesis or fuel gas containing entrained particulate carbon comprises a vertical unpacked free-flow noncatalytic cylindrically shaped steel pressure vessel lined with refractory, such as shown in coassigned U.S. Pat. No. 2,809,104. A typical quench drum is also shown in said patent. A burner, such as shown in coassigned U.S. Pat. No. 2,928,460, may be used to introduce the feed streams into the reaction zone. These coassigned U.S. patents are incorporated herein by reference. The atomic ratio of free oxygen to carbon in the fuel (O/C ratio), is in the range of about 0.6 to 1.6, and preferably about 0.8 to 1.4. When steam is used as a temperature moderator the steam-to-fuel weight ratio in the reaction zone is in the range of about 0.1 to 5, and preferably about 0.2 to 0.7.

The composition of the hot raw effluent gas stream from the reaction zone of the partial oxidation gas generator is about as follows, in mole percent: $H_2$ 10 to 70, CO 15 to 57, $CO_2$ 0.1 to 25, $H_2O$ nil to 20, $CH_4$ nil to 60, $H_2S$ nil to 2, COS nil to 0.1, $N_2$ nil to 60, and Ar, nil to 2.0. Particulate carbon is present in the range of about 0.2 to 20 weight % (basis carbon content in the original feed). Depending on the composition after removal of the entrained particulate carbon and any ash by quench cooling and/or scrubbing with water and with or without dewatering, the gas stream may be employed as synthesis gas, reducing gas, or fuel gas.

All of the hot raw effluent gas stream leaving the reaction zone of the partial oxidation gas generator at a temperature in the range of about 1,700° to 3,500° F., such as in the range of about 2,000° to 2,800° F., and a pressure in the range of about 5 to 300 atmospheres, such as about 15 to 200 atmospheres maybe passed directly into a thermally insulated refractory lined chamber and split into two separate hot raw gas streams. In coassigned U.S. Pat. No. 4,141,696, which is incorporated herein by reference, one raw gas stream is quench cooled in water and the other is cooled in a convection-type gas cooler and then scrubbed with water. The carbon-water dispersion that is produced in the gas-quench cooling and cleaning operations comprises in the range of about 0.1 to 4.5 wt.% say about 0.5 to 2.0 wt.% of particulate carbon and is then processed in a conventional decanting zone to produce the liquid organic extractant-carbon water-dispersion in line 13. From about 0 to 50 volume %, such as 10 to 20 volume %, say 15 volume % of the total effluent gas from the partial oxidation gas generator may be directly introduced into extractant purifier 1 by way of line 20. The temperature and pressure of the raw gas stream is substantially the same as that in the reaction zone of the gas generator less ordinary drop in the lines. Alternatively, by-product superheated steam at a temperature in the range of about 300° to 1200° F. may be produced by the gas cooler associated with one of the split streams and introduced into extractant purifier 1 by way of line 20.

The term liquid hydrocarbonaceous fuel, as used herein to describe suitable feedstocks for the partial oxidation gas generator, is intended to include various materials, such as liquefied petroleum gas, petroleum distillates and residua, gasoline, naphtha, kerosine, crude petroleum, asphalt, gas oil, residual oil, tarsand oil and shale oil, coal derived oil, aromatic hydrocarbons (such as benzene, toluene, xylene fractions), coal tar, cycle gas oil from fluid-catalytic-cracking operations, furfural extract of coker gas oil, and mixtures thereof.

Also included within the definition of the term hydrocarbonaceous fuel are liquid oxygenated hydrocarbonaceous organic materials including carbohydrates, cellulosic materials, aldehydes, organic acides, alcohols, ketones, oxygenated fuel oil, waste liquids and by-products from chemical processes containing oxygenated hydrocarbonaceous organic materials and mixtures thereof.

The term free-oxygen containing gas as used herein means air, oxygen-enriched-air i.e. greater than 21 mole % $O_2$, and substantially pure oxygen, i.e. greater than about 95% mole oxygen (the remainder usually comprising $N_2$ and rare gases).

The dispersion of carbon-water produced in the hot raw gas quench cooling and scrubbing operations is resolved by being introduced in admixture with a suitable liquid organic extractant such as light liquid hydrocarbons i.e. naphtha into a carbon separation or decanter zone. In this manner, the carbon may be separated from the water, and clarified water may be recycled to the gas quenching and scrubbing zones. Conventional horizontal and vertical decanters may be employed. The liquid organic extractant may be added in one or two stages. A description of suitable vertical decanters, liquid organic extractants, and methods of operation are described in coassigned U.S. Pat. No. 4,014,786, which is incorporated herein by reference.

Suitable liquid organic extractants that form dispersions with the particulate carbon and which are lighter than and immiscible with water include: (1) light liquid hydrocarbon fuels having an atmospheric boiling point in the range of about 75° to 450° F., say about 125° to 375° F., density in degrees API in the range of over 20 to about 100, and a carbon number in the range of about 5 to 16; (2) a mixture of substantially water insoluble liquid organic by-products from an oxo or oxyl process; and (3) mixtures of types (1) and (2). Examples of type (1) liquid extractants include butanes, pentanes, hexanes, toluol, natural gasoline, gasoline, naphtha, gas oil, their mixture and the like. Ingredients in the mixture comprising type (2) extractants include at least one alcohol, at least one ester and at least one constituent from the group consisting of aldehydes, ketones, ethers, acids, olefins, and saturated hydrocarbons.

The particulate carbon in the carbon-water dispersion that is introduced into the decanter is in the form of free-carbon black or soot. The particle size is in the range of about 0.5 to 1 microns. The Oil Absorption No. of the carbon soot, as determined by ASTM Method D-281, is greater than 1 and usually varies from 2 to 4 cc of oil per gram of C.

The decanter is operated at a temperature in the range of about 180° to 650° F. and preferably about 250° F. The pressure in the decanter is in the range of about 75 to 4500 psig, such as about 75 to 600 psig, say about 75 to 400 psig, and must be high enough to keep the liquid organic extractant in a liquid phase. Thus, when the decanter bottoms outlet temperature is 300° F., and the liquid organic extractant is naphtha, the pressure in the decanter may be at least 300 psia. The total amount of liquid organic extractant that may be introduced into a one or two-stage decanting operation is in the range of about 10 to 200 times, such as 30 to 70 times, the weight of the particulate carbon in the carbon-water dispersion.

The stream of clarified water resulting from the resolution of the carbon-water dispersion in the decanter comprises about 100 to 500 parts per million by weight of particulate carbon and contains about 20 to 60 wt.% of any ash present. The clarified water separates out by gravity and leaves at the bottom of the decanter. A dispersion stream of liquid organic extractant- carbon-water in liquid phase is removed from the upper section of the decanter substantially comprising about 0.5 to 9 wt.%, say over 2.5 to 4.5 wt.% of particulate carbon, about 0.5 to 10 wt.% water, and the remainder liquid organic extractant. The streams of clarified water and the liquid organic extractant-carbon-water dispersion may leave the decanter at a temperature in the range of about 180° to 650° F., such as about 250° to 350° F.

Spray nozzle or atomizing device 12 at the discharge and of inlet conduit 11 within chamber 1 atomizes the liquid organic extractant-carbon-water dispersion into a fluid-like spray of fine droplets having a particle size in the range of about 1 to 100 microns, say about 5 to 50 microns. Any suitable conventional atomizing device may be employed including: pressure nozzles, rotating discs, and sonic nozzles. Pressure nozzles may operate with a pressure in the range of about 75 to 8,000 lbs/sq.in., say about 400 to 4,500 lbs. per sq.in. Disc speeds may range from about 2,000 to 60,000 r.p.m., say about 2,500 to 10,000 r.p.m.

Operation of the extractant purifier should preferably take place at a temperature above the dew point of the liquid organic extractant or $H_2O$ whichever is greater and below the initial boiling point of the liquid hydrocarbon fuel scrubbing fluid. By this means liquid organic extractant and scrubbing fluid losses are minimized and the production of wet soot which is difficult to separate is avoided. During operation, the liquid organic extractant is in the vapor phase while the liquid hydrocarbon fuel scrubbing fluid is in the liquid phase. To avoid cracking of the liquid organic extractant in the extractant purifier while assuring complete vaporization of the water and liquid organic extractant, the extractant purifier is maintained at a critical temperature of below 1000° F., such as in the range of about 300° F. to 700° F., say 450° F. to 550° F. The partial pressure of the of liquid organic extractant-carbon-water dispersion in the vaporizer is maintained below the vapor pressure of the dispersion components at the above temperatures so that complete vaporization and optionally some superheating, i.e., 50°-200° F. superheat can occur. In one embodiment, the operating pressure in the extractant purifier is in the range of about 75 to 2000 psig., such as about 200 to 1000 psig., say 800 psig. About 0 to 1.0, such as about 0.1 to 1.0, say about 0.3 to 0.6 lbs. of the hot raw synthesis or fuel gas stream, or superheated steam may be required to vaporize each pound of liquid organic extractant-carbon-water dispersion.

The liquid hydrocarbon fuel scrubbing fluid coats the entrained carbon particles and forms a liquid hydrocarbon fuel-carbon dispersion that may be easily separated by gravity as a liquid and removed from the bottom of the vessel. At least a portion, and preferably all of the stream of liquid hydrocarbon fuel-carbon dispersion which is produced at a temperature in the range of about 300° F. to 700° F. is recycled to the gas generator as at least a portion of the fuel. Alternatively, at least a portion of this dispersion may be exported as fuel.

The liquid hydrocarbon fuel scrubbing fluid has a density in degrees API of 10 or less, and an initial boiling point in the range of about 400° to 800° F., such as over 450° to 500° F., when measured at atmospheric pressure in accordance with standard test methods of the American Society For Testing and Materials. Suitable liquid hydrocarbon fuel scrubbing fluids may be selected from the group comprising fluid residua from petroleum distillation and cracking process operations, petroleum distillate, reduced crude, whole crude, asphalt, coal tar, coal derived oil, shale oil, tar sand oil, and mixtures thereof. Pumpable slurries of solid carbonaceous fuel, e.g. particulate carbon, petroleum coke, and mixtures thereof in a liquid hydrocarbon fuel such as one previously listed are included within the definition of liquid hydrocarbon fuel scrubbing fluid.

Advantageously, significant savings result in the subject scheme by the elimination of equipment normally employed in conventional carbon recovery systems or by size reduction of the equipment. For example, when 5 to 50 volume % of the hot raw effluent gas stream from the gasifier is cooled by vaporizing the decanter overhead stream, the quench drum or gas cooler employed in cooling the remainder of the hot raw gas stream may be smaller and quench water requirements are reduced. This permits the decanter to be scaled down, and a reduction in the amount of liquid organic extractant used. There is also a smaller soot-load to the decanter because the particulate carbon entrained in the hot raw gas stream in line 20 is separated in gas-solids separator 40. Thus, the fractionation equipment, that is used in conventional systems to recover extractant and carbon and which require fired heaters with their additional fuel requirements and associated energy losses are completely eliminated by use of the subject extractant purifier. In addition, costly control valves and pressure sensors may be eliminated with attendant instrumentation and feed back control loop.

Comparatively low cost circulators that utilize less energy can be used in the subject process in place of expensive liquid pumps. Further, clean streams of product gas may be produced at substantially the same pressure as the gas generator, less ordinary pressure drop in the lines. By running the gas generator at high pressure, the product gas may be produced at high pressure, thereby eliminating costly gas compressors.

While particular embodiments of the invention have been described above in considerable detail, this is not to be taken as in any way limiting the invention but merely as being descriptive thereof.

EXAMPLE

The following example illustrates the continuous operation of a preferred embodiment of this invention as shown in the drawing pertaining to an extractant purifier. While preferred modes of operation are illustrated, the Example should not be construed as limiting the scope of the invention. The process is continuous and the flow rates are specified on an hourly basis for all streams of material.

717.8 lbs. of naphtha-carbon-water dispersion from a conventional decanter to be purified enters extractant purifier 1 by atomizer 12 at a temperature of 250° F. and a pressure of 800 psig. This dispersion stream comprises in weight % naphtha 87.6, carbon 3.6, and water 8.8. The atomized mixture comes in direct contact with a raw hot synthesis gas stream. The raw hot synthesis gas stream is produced in a conventional free-flow noncatalytic partial oxidation gas generator and directly enters the extractant purifier at the rate of 7.0 thousand standard cu. ft. (SCF) by nozzle 24 at 2300° F. and 800 psig. The stream of raw hot synthesis gas has the following composition: CO 38.03, $H_2$ 38.34; $CO_2$ 6.35; $H_2O$ 13.57; $CH_4$ 3.34; Ar 0.06; $N_2$ 0.03; $H_2S$ 0.28; and, COS 0.00. The extractant purifier is maintained at a temperature in the range of 450° to 550° F. and a pressure of 800 psig. By direct heat exchange in the extractant purifier, the droplets of naphtha-carbon-water dispersion absorb the sensible heat in the raw gas stream. The naphtha and water are completely vaporized and the raw gas is cooled with a resultant temperature of 500° F. There is substantially no side reaction of the naphtha. There is no external heating of the extractant purifier.

The vaporized naphtha and water and cooled, raw synthesis gas and particulate carbon pass through gas-solids separator 40 located within refractory lined vessel 1. About 38 lbs. of clean, dry particulate carbon exit separator 40 through diplegs 46. The gaseous naphtha and water and raw gas exit the separator and extractant purifier through 47 and 5. This gaseous stream is then cooled in a cooler located downstream from vessel 1 to a temperature in the range of 75° F.-150° F. in order to condense out and separate in a separator (not shown) a mixture of purified liquid naphtha and water from 6.05 thousand SCF of clean dewatered gas. This gas stream may be employed as synthesis gas. The naphtha-water mixture is then separated into 628.5 lbs. of naphtha, which is recycled to a decanter where it is used again to extract carbon from a water stream, and 108 lbs. of water which is recycled to a quench drum or gas scrubber associated with the gas generator.

The 38 lbs. of clean, dry particulate carbon and ash that exit separator 40 through diplegs 46 are contacted in the lower part of extractant purifier 1 with 421 lbs. of a vacuum resid liquid hydrocarbon fuel that enters the extractant purifier through nozzle 53 at a temperature of 500° F. The vacuum resin having a gravity of 8.8 degrees API and an Ultimate Analysis in weight percent as follows: C 86.5; H 9.77; N 0.87; S 1.98; O 0.71; and ash, 0.17. The liquid hydrocarbonaceous fuel-carbon dispersion exits the extractant purifier through line 55 and can be recycled as feed to the partial oxidation gas generator.

Advantageously, naphtha and carbon are recovered from the naphtha-carbon-water dispersion for reuse by the subject method with a savings of at least 10% of the thermal energy requirements in comparison with conventional naphtha recovery methods such as by distillation.

The process of the invention has been described generally and by example with reference to a hydrocarbonaceous fuel, synthesis gas and fuel gas of particular compositions for purposes of clarity and illustration only. It will be apparent to those skilled in the art from the foregoing that various modifications of the process and materials disclosed herein can be made without departure from the spirit of the invention.

I claim:

1. A process for removing entrained particulate carbon in a stream of normally liquid organic extractant-carbon-water dispersion as separated from a carbon-water dispersion in a decanting zone comprising:

(1) introducing into a closed vertical cylindrical thermally insulated pressure vessel near the middle, an atomized or an at least partially vaporized stream of normally liquid organic extractant-carbon-water dispersion;

(2) introducing into said vessel near the middle a stream of hot raw synthesis of fuel gas or superheated steam when an atomized or a partially vaporized stream of liquid organic extractant-carbon-water dispersion is introduced in (1);

(3) atomizing and spraying into said vessel near the lower end a stream of liquid hydrocarbon fuel scrubbing fluid;

(4) completely vaporizing said normally liquid organic extractant-carbon-water dispersion and separating the entrained particulate carbon from said vapors in a gas-solids separation means located within the upper portion of said vessel;

(5) discharging the vaporized liquid organic extractant and water separated in (4) from said vessel;

(6) discharging the particulate carbon separated in (4) into the spray of liquid hydrocarbon fuel scrubbing fluid in (3) to produce a liquid hydrocarbon fuel-carbon liquid phase dispersion; and (7) discharging the liquid phase dispersion produced in (6) from the vessel.

2. The process of claim 1 with the added steps of cooling the vaporized liquid organic extractant and water from (5) below their dew points and separating from each other liquid organic extractant, water, and any synthesis or fuel gas.

3. The process of claim 2 with the added step of recycling said liquid organic extractant to the decanting zone to resolve said carbon-water dispersions.

4. The process of claim 1 wherein said gas-solids separation means in (1) is selected from the groups consisting of single-stage cyclone separator, multi-stage cyclone separator, impingement separator, and combinations thereof.

5. The process of claim 1 provided with the additional step of at least partially vaporizing said stream of normally liquid organic extractant-carbon-water dispersion from the decanter by passing same through an expansion means.

6. The process of claim 5 wherein said expansion means is a heating means or expansion turbine.

7. The process of claim 5 wherein said expansion means is an orifice or expansion valve.

8. The process of claim 1 wherein the liquid hydrocarbon fuel-carbon liquid phase dispersion from (7) is introduced into a partial oxidation gas generator as a portion of the reactant feed.

* * * * *